US008210287B1

(12) United States Patent
Moller et al.

(10) Patent No.: US 8,210,287 B1
(45) Date of Patent: Jul. 3, 2012

(54) MINING CORE DRILL BIT AND METHOD OF MAKING THEREOF

(75) Inventors: Karl H. Moller, North Palm Beach, FL (US); Andrew L. Jedick, Avon Lake, OH (US); Thomas G. Ruffner, Oberlin, OH (US)

(73) Assignee: Diamond Products, Limited, Elyria, OH (US)

( * ) Notice: Subject to any disclaimer, the term of this patent is extended or adjusted under 35 U.S.C. 154(b) by 278 days.

(21) Appl. No.: 12/651,713

(22) Filed: Jan. 4, 2010

Related U.S. Application Data

(60) Provisional application No. 61/142,398, filed on Jan. 5, 2009.

(51) Int. Cl.
*E21B 10/02* (2006.01)

(52) U.S. Cl. ..... 175/405.1; 175/403; 175/425; 175/435

(58) Field of Classification Search ..... 175/403, 175/387, 405.1, 425, 435; 76/108.1, 108.2, 76/108.4, 108.6; 51/293
See application file for complete search history.

(56) References Cited

U.S. PATENT DOCUMENTS

| | | | | |
|---|---|---|---|---|
| 2,738,167 | A * | 3/1956 | Williams, Jr. | 175/246 |
| 3,833,077 | A * | 9/1974 | Lavallee | 175/325.2 |
| 4,208,154 | A * | 6/1980 | Gundy | 408/204 |
| 5,590,729 | A | 1/1997 | Cooley et al. | |
| 5,653,812 | A | 8/1997 | Petrmichl et al. | |
| 5,996,571 | A | 12/1999 | Jedick | |
| 6,209,420 | B1 | 4/2001 | Butcher et al. | |
| D466,139 | S | 11/2002 | Kim et al. | |
| 6,595,844 | B1 | 7/2003 | Mizuno et al. | |
| D481,045 | S | 10/2003 | Ahn | |
| 6,742,611 | B1 | 6/2004 | Illerhaus et al. | |
| 6,846,341 | B2 | 1/2005 | Middlemiss | |
| 6,868,848 | B2 | 3/2005 | Boland et al. | |
| 7,204,244 | B1 | 4/2007 | Pedersen | |
| 2003/0029296 | A1 * | 2/2003 | Donazzan | 83/835 |

* cited by examiner

*Primary Examiner* — Cathleen Hutchins
(74) *Attorney, Agent, or Firm* — Rankin, Hill & Clark LLP

(57) ABSTRACT

A core drill bit includes an elongate hollow cylindrical body having opposite first and second ends with an end section having an end face defining an annular non-planar surface. The cutting head includes a plurality of circumferentially spaced apart cutting segments, the cutting segments being electrical welded to the non-planar surface whereby raised portions of the surface melt during the welding to affix the cutting segments with the face of the tool body.

20 Claims, 4 Drawing Sheets

MINING CORE DRILL BIT AND METHOD OF MAKING THEREOF

BACKGROUND OF INVENTION

1. Field of Invention

The present application relates to diamond cutting tools. More particularly, the present application concerns new and improved diamond mining core drill bits or hole saws for cutting rock and earth, and to methods of manufacturing diamond mining core drill bits.

2. Description of Related Art

Diamond core drilling equipment is used extensively to drill circular or annular holes in a variety of materials. Annular holes are formed in rock, earth, concrete, asphalt, and related materials for a variety of reasons. For example, holes are drilled in rock during mining or during exploration for purposes of determining soil compaction, determining soil percolation or to perform other geological research. Further, for example, holes are also commonly drilled in concrete and similar materials for the purpose of correcting the settlement of pavement or to provide openings to utility conduit cells located beneath the surface of cast concrete floors of office and factory buildings. Further, for example, holes are also commonly drilled in concrete or masonry to facilitate the mounting of objects such as posts or pipes.

Examples of prior art diamond core drill bits or hole saws of a general type that are commonly used in construction and/or concrete applications are shown in Jedick, U.S. Pat. No. 5,996,571, which is assigned to the assignee of the present application. As discussed in the Jedick '571 patent, the segments of such bits are commonly attached using laser welding techniques.

Generally speaking, diamond core drilling equipment comprises a motor-driven core drill assembly including a down-hole mining core drill bit or hole saw. The core drill assembly may embody various configurations, but such assembly generally comprises a base and a guide column extending up from the base or a drilling rig. A carriage may be provided between the column and the motor for guiding the motor along the column as the pipe extensions and mining core drill bit are advanced beneath the ground surface. Generally, the core bit is attached to the pipe extensions using a driver or reaming tool.

The prior art provides various types of core drill bits for use in mining. However, the majority of commercial mining bits used today have cutting heads formed of a diamond impregnated material. More particularly, the cutting head comprises a plurality of cutting segments or teeth mounted at the distal end of the cylindrical body of the bit. Each of the segments is attached to the cylindrical body of the bit using an infiltration process. This, however, is a time consuming operation, it is costly, and may at times result in inadequate adhesion of the segments with the body. Often, the infiltrated material "drips" onto unintended portions of the body and must be cleaned afterwards. A substantial investment of energy and time may be required to clean the tool of the stray brazing material.

BRIEF SUMMARY OF THE INVENTION

The present invention provides a new and improved mining core drill bit or hole saw for cutting annular holes in rock, earth, concrete, masonry, stone, asphalt and similar materials and, further, includes methods of manufacturing these mining core drill bits. The drill bit and method of making the drill bit provide several distinct advantages over the bits and methods of the prior art. More particularly, the present invention provides a drill bit with a cutting head securely mounted to the tool body. Bits having this construction have a lower cost and exhibit a truer cut, better tracking, and a longer life as compared to prior art bits. The present invention also provides a method for constructing a core drill bit that is simpler than the prior art methods and provides a lower cost drill bit that exhibits a better adhesion or coupling between the cylindrical body of the bit and the one or more cutting segments. The method of the present invention also allows for the use of segments having varied compositions without concern for loss of bond integrity as between the segments and the bit body.

In one preferred embodiment, the mining core drill bit comprises an elongate hollow cylindrical body and a cutting head mounted thereto. The cylindrical body has a first end section and an opposite second end section. The first end section has an attaching portion for selectively attaching the core drill bit to an associated driver for rotating the core drill bit relative to an associated material such as rock, stone, earth, or the like. The second end of the cylindrical body has an end face defining an annular non-planar surface. The cutting head is mounted to the end face.

In one form, the cutting head includes a plurality of cutting segments mounted on the annular non-planar surface. In one form, the cutting segments are electrically welded to the annular non-planar surface. One preferred method of electrically welding the cutting segments includes capacitive discharge welding the segments to the annular non-planar surface. Essentially, the non-planar surface functions during construction of the drill bit to channel current through localized regions at the interface between the tool body end face and the cutting head segments to act as one or more current concentrators for localized high energy concentrations. The high heat and current in these regions cause portions of the non-planar end face surface to melt together with, in some cases, portions of the cutting head segments thereby realizing a sound and secure connection therebetween.

In another form, the plurality of cutting segments are circumferentially spaced apart on the annular non-planar surface defining alternating sectors of cutting segment regions and gap regions of the cutting head. After the cutting segments are electrically welded to the annular non-planar surface, the sectors of the cutting segment regions define end faces substantially planar and conforming to a surface of the cutting segment being in abutment with the cylindrical body. In the sectors of the gap regions, the end face of the cylindrical body has a non-planar surface.

In a further form, the end face includes at least one of a ridge and a groove but, preferably, the end face includes a plurality of concentric ridge and groove portions.

In its preferred form, the cutting segments comprise a mixture of iron, carbides and diamonds. In one such embodiment the segments comprise by weight a mixture of about 30% iron, about 30% copper, 30% cobalt, and 10% tungsten carbide; and with diamond particles/grit/powder of about 0-25% by volume added to the foregoing mixture.

In another form, the cutting head provided includes providing a cutting head including a plurality of cutting segments and, the mounting includes mounting the plurality of segments to the body by first circumferentially spacing the segments out about the non-planar surface and, thereafter, welding the plurality of cutting segments with the body. Preferably, the welding is performed using a capacitive discharge welder.

In its preferred form, the electrical welding includes welding the segments with the cylindrical body whereby first portions of the non-planar surface of the end face concentrate an amount of current per square inch flowing through the cutting head and the cylindrical body during the electrically welding step and melts the first portion and conforms the first portion to the rear side of the segments. Overall, this provides a sound and secure bond between the segments and the tool body.

In another form of the method of making a core drill bit, during the welding step the segments may be pressed with the cylindrical body using a pressure of about 6.6 Bar.

In still another form, the welding step includes electrically welding the cutting head with the cylindrical body using a burst of energy of about 16K joules.

In yet another form, the invention provides a reaming tool having cutting segments that are electrically welded to the body of the reamer.

BRIEF DESCRIPTION OF THE DRAWINGS

The foregoing aspects and others will be pointed out more fully hereinafter in conjunction with the written description of the preferred embodiments of the invention illustrated in the accompanying drawings in which.

DETAILED DESCRIPTION OF THE INVENTION

Figure 1:
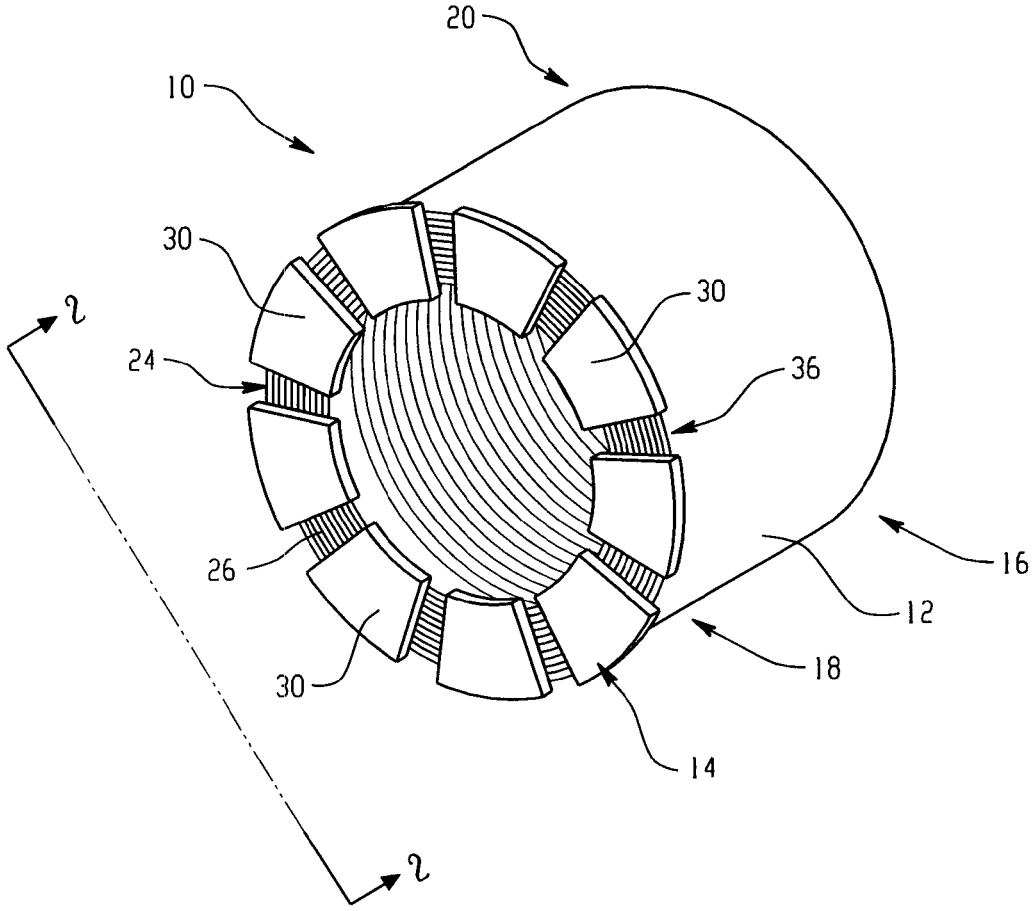
FIG. 1 is a perspective view of a core drill bit made in accordance with a preferred embodiment.
Figure 3:
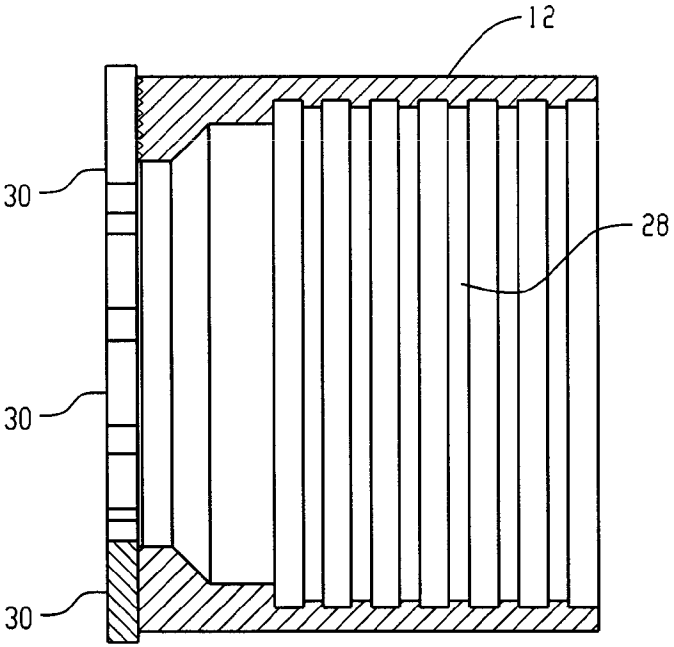
FIG. 3 is a cross-sectional view taken along line 3-3 of FIG. 2.
Figure 2:
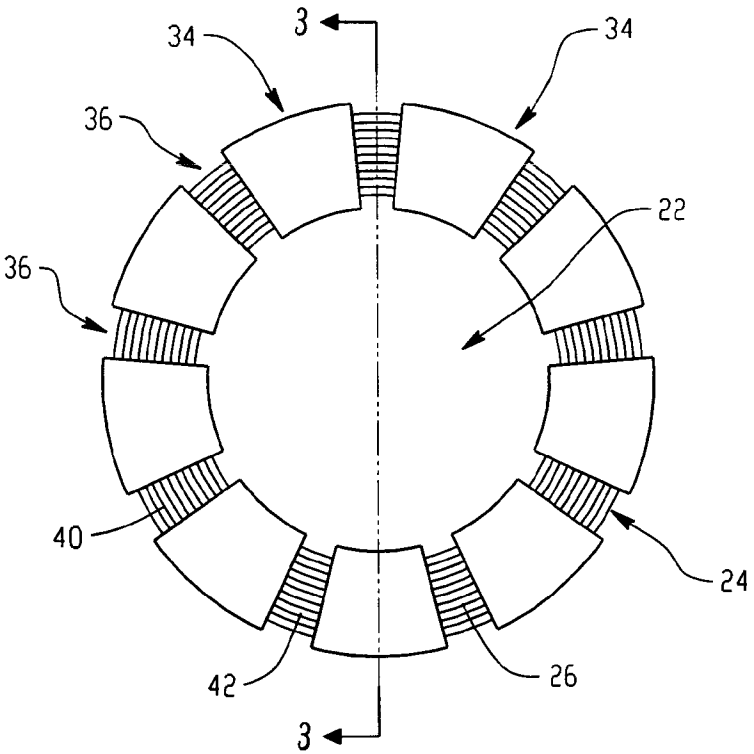
FIG. 2 is an end view of the core drill bit as viewed along the line 2-2 in FIG. 1.

Referring now to the drawings wherein the showings are for purposes of illustrating the preferred embodiments of the invention only and not for purposes of limiting same, and initially to FIGS. 1-3, there is shown a core drill bit or hole saw 10 formed in accordance with a preferred embodiment of the present invention. The bit 10 includes an elongate hollow cylindrical body 12 and a cutting head 14 disposed on the body 12. The body 12 has a first end section 16 and an opposite second end section 18. The first end section 16 has an attaching portion 20 for selectively attaching the core drill bit 10 to an associated driver such as, for example, a reaming shell for rotating the core drill bit 10 relative to the associated material. The second end section 18 has an end face 24 defining an annular non-planar surface 26. In the embodiment illustrated, preferably, the cutting head 14 is formed on the end face 24. Further, in the embodiment illustrated, the cylindrical body 12 defines a circular hole or opening 22 therethrough so that the drill bit may function as a coring drill bit to remove or extract materials such as, for example, soil samplings, and/or rock or other formations. Also, in the preferred embodiment illustrated, the opening 22 at end section 16 enables access to an internal threaded portion 28 comprising the preferred form of the attaching portion 20. The internal threaded portion 28 enables the selective connection of the subject drill bit 10 with an associated driving member having corresponding external threaded portions.

In the preferred embodiment illustrated, the cutting head 14 of the subject drill bit 10 comprises a plurality of cutting segments 30 mounted to the end face 24 of the body 12 such that the cutting head and the body are one unitary piece. However, it will be appreciated that one could form bit 10 by electrically welding a cutting head portion to a drill bit body. As with conventional bits, the cutting segments 30 are slightly wider than the body 12 so as to provide sufficient clearance for the body during mining, drilling, or cutting operations. The end face 24 includes a non-planar surface 26 to facilitate the mounting of the segments as discussed further below. Preferably, the cutting segments 30 are circumferentially spaced apart evenly on the annular non-planar surface 26 as best illustrated in FIG. 2. As shown there, a total of nine (9) cutting segments are provided. More or less segments may be used as necessary or desired.

With continued reference to the drawing figures and, in particular, to FIG. 2, each of the plurality of cutting segments 30 is circumferentially spaced apart on the annular non-planar surface 26 to define alternating cutting segment regions 34 and gap regions 36 of the cutting head 14.

Figure 6:
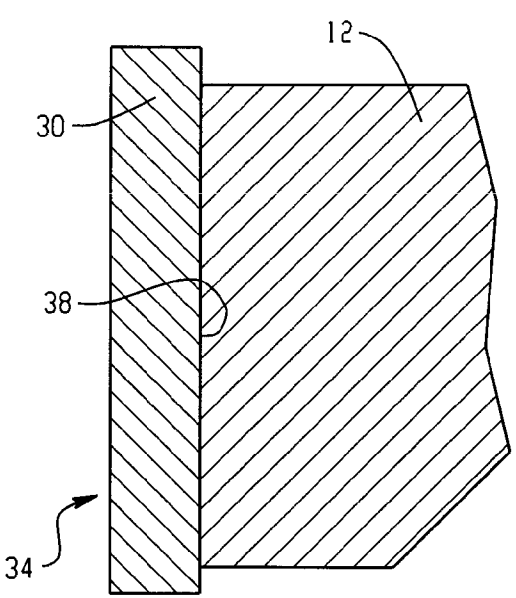
FIG. 6 is a schematic side view of the portion of the end face of the elongate tubular body shown in FIG. 5 with the cutting segment mounted thereto.
Figure 5:
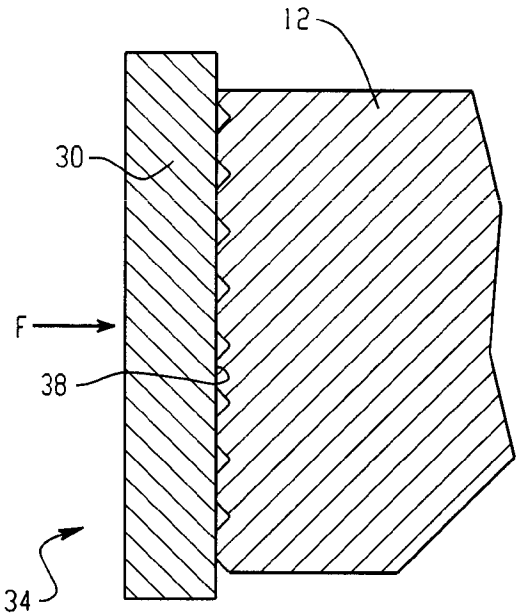
FIG. 5 is a schematic side view of the portion of the end face of the elongate tubular body shown in FIG. 4 as the cutting segment is being mounted thereto.
Figure 4:
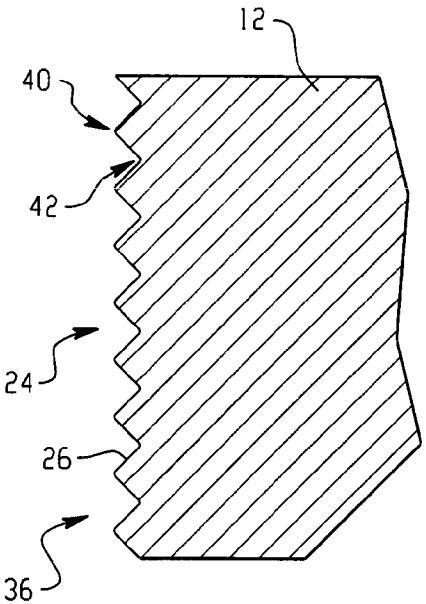
FIG. 4 is a schematic side view of a portion of an end face of an elongate tubular body before a cutting segment has been mounted thereto.

FIGS. 4-6 schematically illustrate the method by which the segments 30 are mounted to the end face 24 of the elongate tubular body 12. In accordance with the preferred embodiment, each segment 30 is electrically welded to the annular non-planar surface 26 of the tool body 12. During this method, the non-planar surface of the end face 24 acts as localized current concentrator so that one or both of the end face 24 and the bottom 38 of the segment 30 melt to thereby bond the segment with the body and form a cutting head. In that way, portions of the non-planar surface 26 located in the cutting segment regions 34 are modified during the method of constructing the tool while portions of the non-planar surface 26 in the gap regions 36 remain unchanged.

In the gap regions 36, the non-planar surface 26 is exposed on the second end section 18 of the tool body 12. The surface in the gap regions 36 has a shape and configuration corresponding to the shape and configuration of those surfaces prior to the electrical welding of the cutting head to the body. However, as best shown in FIG. 6, the non-planar surface in the cutting segment regions 34 becomes substantially planar to conform to a surface 38 of the cutting segment 30 in abutment with the cylindrical body 12. Preferably, the segments 30 are attached to the body one at a time; however, it will be appreciated that it may be possible to weld two or more, or possibly all of the segments at one time to the body.

In its preferred form as best illustrated in FIG. 4, prior to the electrical welding, the non-planar surface 26 includes a plurality of ridges 40 and grooves 42. The ridges and grooves have an orientation, arrangement, and proportion as shown in the drawing figure. It is to be appreciated that, in accordance with the preferred method of making a core drill bit in accordance with the present invention, the ridges 40 function to channel and thereby concentrate current flowing between the drill bit body 12 and the cutting segments 30 during the electrical welding process. The welding process may include resistance welding or, preferably, capacitive discharge welding the cutting head 14 with the tool body 12. Overall, the preferred form of the tool body 12 is cylindrical and, accordingly, the ridges and grooves 40, 42 define a plurality of concentric ridges 40 and grooves 42. Other forms of concentrating current flowing at the interface between the cutting head 14 and the body 12 may be utilized as necessary, or desired, such as, for example, a plurality of spaced apart raised portions, a plurality of radially extending ridge and/or groove portions, or other shapes, patterns, or configurations provided on the end face 24 to define a non-planar surface 26.

The cutting segments preferably comprise a mixture of iron, copper, cobalt and carbide, and optionally diamonds. In one preferred embodiment the segments comprise by weight a mixture of about 30% iron, 30% copper, 30% cobalt, 10% tungsten carbide. Diamond particles/grit/powder of about 0-25% by volume may be added to the mixture. Other compositions may be utilized as well. Additionally, when diamonds are utilized, the distribution of the diamond may be varied throughout the width and height of the segments in order to affect the cutting properties of the segments.

The segments may be produced in a conventional manner using conventional means preferably include a dispersion of diamonds with a particle size of between 40/50 US Mesh and about 30/40 US Mesh. This designates a diamond particle size such that about 460 to about 1,300 of such particles are equivalent to one karat.

Core drill bits of the preferred embodiment exhibit truer cuts, better tracking and a longer life as compared to conventional bits which include cutting segments attached to the tool body using brazing or other techniques.

During the welding operation the segments (welded one at a time) may be pressed using a pressing force F during the electrical welding operation as shown in FIG. 5. As an example, the cutting head segment 30 may be pressed with the cylindrical body using a pressure of about 6.6 Bar. Additionally, preferably, the welding is performed using a capacitive discharge welding machine set to deliver a burst of energy of about 16K joules at a voltage of 3200V. An example of such a machine that is suitable for use with the present invention is a discharge machine made by Sciaky, Inc. of Chicago, Ill.

It is to be appreciated that although a pressing force F is described and a particular range of energy other pressing forces may be utilized and other ranges of energy may be required more or less based upon application and specifically the size and number of segments being welded. In the subject embodiment, by way of example only and not for purposes of limiting the preferred embodiments, the cylindrical body 12 has a diameter of about 3.0 inches and a longitudinal length of about 2.375 inches. Accordingly, scaling of the above-mentioned energy burst and/or pressing force F is to be expected.

Figure 8:
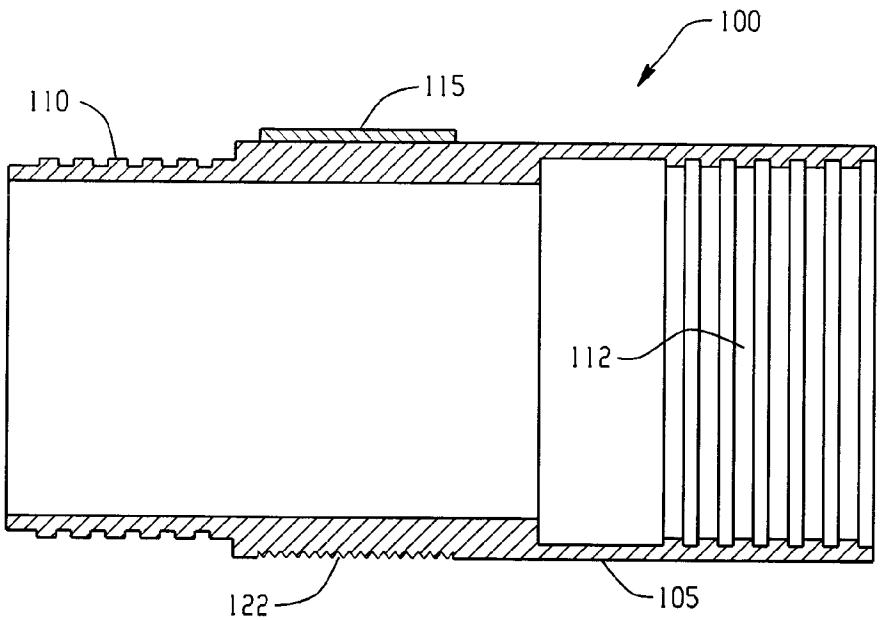
FIG. 8 is a cross-sectional view taken along line 8-8 of FIG. 7.
Figure 7:
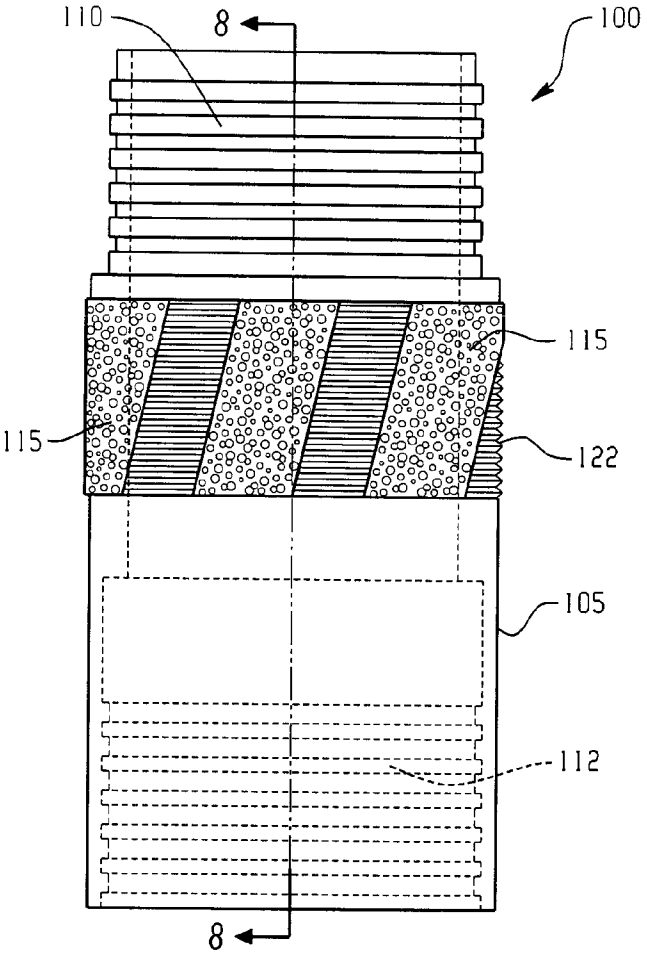
FIG. 7 is a side view of a driver or reamer made in accordance with the invention.

Referring now to FIGS. 7 and 8 there is shown a driver or reaming tool 100 suitable for use with the core drill bit 10. Reamer 100 is conventional in nature having a hollow cylindrical body 105, a male threaded end 110 and a female threaded end 112 for receiving pipe extensions. A plurality of cutting segments 115 are disposed along the outside of reamer 100. Although segments 115 differ in shape from the segments 30 of bit 10, preferably, they have a similar chemistry and are attached in a similar manner. Specifically, preferably mid-portion 120 of reamer 100 includes a non-cylindrical portion 122 to which segments 115 are electrically welded to, and preferably, welded using capacitive discharge welding. The non-cylindrical portion 122 preferably includes a plurality of concentric ridges and grooves.

The claimed invention has been described in connection with the preferred embodiments. However, it is to be appreciated that the embodiments of the invention have use in equipment other than mining equipment, and in other applications such as drilling concrete, asphalt, masonry and related materials. Obviously, alterations and changes may occur to those of ordinary skill in the art upon a reading and understanding of this specification and any appended claims.

What is claimed:

1. A core drill bit for cutting an annular hole in a material, the core drill bit comprising:

a hollow cylindrical body having a first end section and an opposite second end section, the first end section having an attaching portion for selectively attaching the core drill bit to a driver for rotating the core drill bit relative to the material, the second end section having an end face defining an annular non-planar surface, the annular non-planar surface having a plurality of ridges and grooves; and a plurality of cutting segments mounted to said end face.

2. The core drill bit according to claim 1 wherein said plurality of cutting segments are electrically welded to said annular non-planar surface.

3. The core drill bit according to claim 2 wherein said plurality of cutting segments are electrically welded to said annular non-planar surface by resistance welding or capacitive discharge welding.

4. The core drill bit according to claim 1 wherein said plurality of cutting segments are circumferentially spaced apart on said annular non-planar surface thereby defining alternating cutting segment regions and gap regions.

5. The core drill bit according to claim 4 wherein:

in each cutting segment region, said end face is substantially planar to conform to a bottom surface of each of said plurality of cutting segments in abutment with said cylindrical body; and in said gap regions, said end face has a non-planar surface.

6. The core drill bit according to claim 1 wherein the plurality of ridges and grooves of the end face include a plurality of concentric ridges and grooves.

7. The core drill bit according to claim 1 wherein said cutting segments comprise a mixture of iron, copper, cobalt, and carbide.

8. The core drill bit according to claim 7 wherein said segments further include diamonds, and said carbide comprises tungsten carbide.

9. A method of making a core drill bit for cutting an annular hole in a material, the method comprising:

providing a hollow cylindrical body having a first end section and an opposite second end section, the first end section having an attaching portion for selectively attaching the core drill bit to a driver for rotating the core drill bit relative to the material, the second end section having an end face defining an annular non-planar surface, the annular non-planar surface having a plurality of ridges and grooves;

providing a cutting segment; and mounting the cutting segment to the non-planar surface of the end face of the body by electrically welding.

10. The method according to claim 9 wherein said mounting step includes electrically welding the cutting segment to the body by resistance welding or capacitive discharge welding.

11. The method according to claim 9 wherein:

a plurality of cutting segments are provided; and said plurality of cutting segments are mounted to the non-planar surface of the end face of the body.

12. The method according to claim 9 wherein said mounting the cutting segment to the non-planar surface of the end face of the body by electrically welding includes:

positioning the cutting segment on the cylindrical body with a first portion of the non-planar surface of the end face in abutment with a rear side of the cutting segment; and electrically welding the cutting segment to the body whereby said first portion concentrates an amount of current per square inch flowing through the cutting segment and the body during said electrical welding, melting said first portion and conforming said first portion to said rear side of the cutting segment.

13. The method according to claim 12 further includes pressing the cutting segment into contact with the body during said welding operation.

14. The method according to claim 13 wherein said electrical welding includes electrically welding the cutting segment with the cylindrical body using a burst of energy of about 16K joules.

15. The method according to claim 9 wherein said method includes:

providing a plurality of cutting segments; and circumferentially spacing apart said plurality of cutting segments on said annular non-planar surface to define alternating cutting segment regions and gap regions.

16. The method according to claim 15 wherein said providing said hollow cylindrical body includes providing a body with a second end section having an end face defining an annular non-planar surface including a plurality of concentric ridges and grooves.

17. The method according to claim 16 wherein said providing said plurality of cutting segments includes providing said plurality of cutting segments comprising iron, copper, cobalt, carbide, and diamonds.

18. A method of making a core bit reamer comprising the steps of:

providing an elongate hollow cylindrical body having a first male end for attachment to a core bit, second female end for attachment to a drilling pipe extension, and a mid-section having a non-cylindrical outer surface portion, said non-cylindrical outer surface portion having a plurality of ridges and grooves;

providing a cutting segment; and mounting the cutting segment to the non-cylindrical outer surface portion by electrical welding.

19. The method of claim 18 wherein said method includes:

providing a plurality of cutting segments;

positioning said plurality of cutting segments on the cylindrical body with a portion of said non-cylindrical surface of said mid-section in abutment with a rear side of said plurality of cutting segments;

circumferentially spacing apart said plurality of cutting segments on said non-cylindrical outer surface to define alternating cutting segment regions and gap regions;

electrical discharge welding said plurality of cutting segments to said body whereby said portion of the non-cylindrical surface concentrates an amount of current per square inch flowing through said plurality of cutting segments and said body during the electrical welding, melting said portion of the non-cylindrical surface and conforming the portion of the non-cylindrical surface to said rear side of the plurality of cutting segments; and pressing said plurality of cutting segments into contact with said body during said welding operation.

20. A core drill bit and core bit reamer combination comprising a core drill bit attached to a core bit reamer wherein:

said core dill bit comprises a hollow cylindrical body with a first end and an opposite second end, said first end having a female threaded portion for attachment to said core bit reamer, said second end having an end face defining an annular non-planar surface, said annular non-planar surface having a plurality of ridges and grooves, a plurality of cutting segments mounted to said plurality of ridges and grooves by capacitive discharge welding; and said core bit reamer comprises an elongated hollow cylindrical body with a first end with a male threaded portion for attachment to said core drill bit, a second end with a female threaded portion for attachment to a drilling pipe extension, and a mid-section having a non-cylindrical outer surface portion, said non-cylindrical outer surface portion having a plurality of ridges and grooves, a plurality of cutting segments mounted on said plurality of ridges and grooves by capacitive discharge welding.

* * * * *